US006231204B1

(12) United States Patent
Lo

(10) Patent No.: US 6,231,204 B1
(45) Date of Patent: May 15, 2001

(54) OPTIC PEN WITH ILLUMINATION DEVICE

(76) Inventor: Tian-Lin Lo, No. 27, Lane 452, Chung-Hsing Rd., Pay-Yuh Tsun, Kuan-In Hsiang, Tao-Yuan Hsien (TW)

( * ) Notice: Subject to any disclaimer, the term of this patent is extended or adjusted under 35 U.S.C. 154(b) by 0 days.

(21) Appl. No.: 09/294,023

(22) Filed: Apr. 20, 1999

(51) Int. Cl.[7] ..... B43K 29/10
(52) U.S. Cl. ..... 362/118; 362/206; 250/227.12
(58) Field of Search ..... 362/118, 206, 362/109; 250/227.12

(56) References Cited

U.S. PATENT DOCUMENTS 3,303,337 * 2/1967 Lo ..... 362/118

* cited by examiner

*Primary Examiner*—Alan Cariaso
*Assistant Examiner*—Ronald E. DelGizzi
(74) *Attorney, Agent, or Firm*—Bacon & Thomas, PLLC

(57) ABSTRACT

An optic pen including an end cap with a light source arranged at a front end thereof; a pen tube, secured to the front end of the end cap, for holding a wick; and a lens arranged in a rear end of the pen tube for focusing a ring of light around the wick.

6 Claims, 2 Drawing Sheets

OPTIC PEN WITH ILLUMINATION DEVICE

BACKGROUND OF THE INVENTION

1. Field of the Invention

The present invention relates to an improved structure for an optic pen, and, more particularly, to an optic pen with a lens wit a toroidal optic ring suitable to be used in a night work environment.

2. Description of the Related Art

Pens are generally used only for writing. Consequently, design variations are generally limited to variations in the texture, color, or the shape of a housing. However, these variations have no special utility. If the light level of the environment is inadequate, then the pen cannot be used. If the pen is used under poor lighting conditions, then writing errors will be induced, resulting in illegibility. One method for solving these problems involves adding an extra light source which is very inconvenient to carry and store. For instance, when a policeman performs his duty at night, if he wants to write on a citation, it is possible that the information on the citation will have some errors. Thus, if the prior art pen is supplemented with its own light source, then the aforementioned problems can be resolved.

With conventional optic pens, an illumination device (such as a bulb) is installed on the distal end of the pen tube. Then, a pen wick is then installed within the hollow space of the pen tube where a curved is formed above the hollow space. The curved portion of the structure has a specific orientation so that light emitting from the illumination portion travels to the front end of the pen tube. However, the aforementioned method has a disadvantage in that the curved portion must be designed to match the size of the inner radius of the pen tube for the light to be reflected to the front end of the pen tube. Therefore, the design of the curved portion must be limited.

SUMMARY OF THE INVENTION

The primary object of the present invention is to provide an improved structure for an optic pen including a pen tube, and an illumination portion in a key cover structure. The illumination portion is installed in the rear end of the pen tube. The front end of the illumination section is fitted with a battery, a light emitting diode, and a bulb or a laser module. The front of the pen tube is made of transparent material and the distal end of the pen tube is installed with a circular, or toroidal, optic lens. The key cover structure is then arranged in the distal end of the pen tube. In the key cover structure, a stepped post extends from the upper end of the contact rod with the cylinder. A spring is located above the cylinder and a pressing barrel covers the spring.

According to the aforementioned structure, when a light source emits light toward the front pen tube, the action of the lens creates a circular focusing ring on the upper end of the transparent pen tube. The light is then refracted through the lens toward the wall of the transparent pen tube. The aforementioned light will then be transmitted to the end of the transparent pen tube without impinging on the pen wick. Moreover, the spring covering the post within the key cover structure will generate a resilient force as the key cover is pressed, so that the key cover is retained in a predetermined position. Therefore, the key cover will not slide upwards or downwards, or vibrate.

The various objects and advantages of the present invention will be more readily understood from the following detailed description when read in conjunction with the appended drawings.

DETAILED DESCRIPTION OF THE PREFERRED EMBODIMENTS

Figure 1:
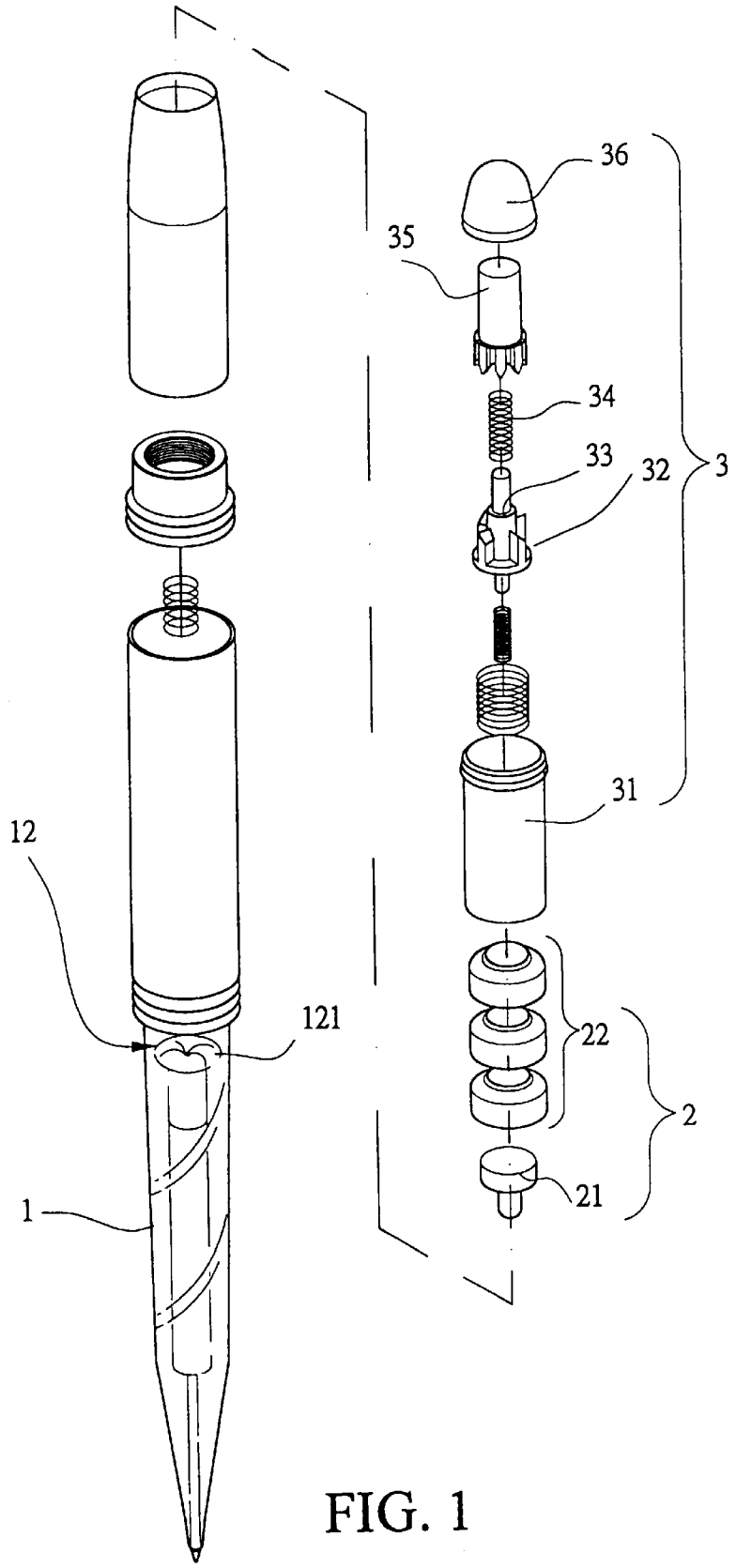
FIG. 1 is an exploded perspective view of the present invention.
Figure 2:
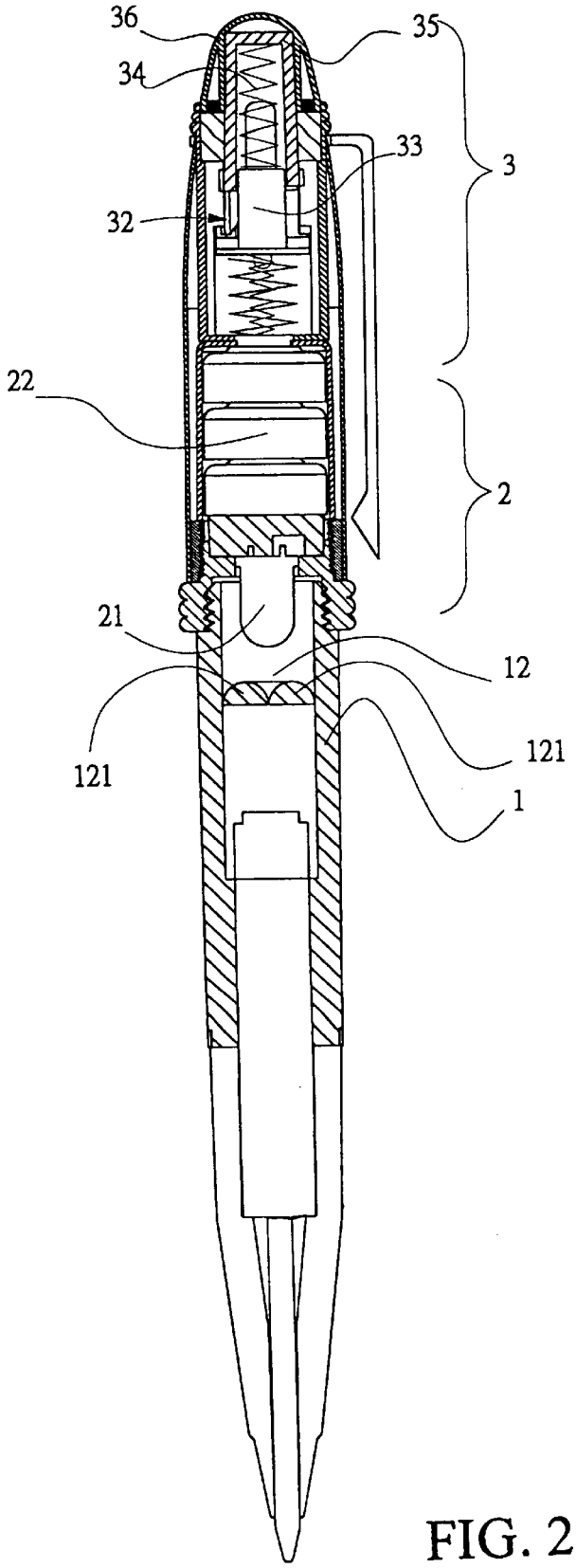
FIG. 2 is an assembled cross-sectional view of the present invention.

With reference now to FIGS. 1 and 2, the optic pen of the present invention includes a pen tube 1, and an illumination portion 2 of a key cover structure, or "end cap," 3. The illumination portion 2 is installed in the distal end of the pen tube 2, and the front end of the illumination section 2 is fitted with batteries 22, a light emitting diode, and a bulb or a laser module 21. The front end of the pen tube 1 is made of transparent material and the distal end of the pen tube is installed with a toroidal optic lens 12.

The key cover structure 3 is arranged in the distal end of the pen tube 1. In the key cover structure, a stepped post 33 extends from the upper end of the contact rod 32 within the cylinder 31. A spring 34 is further located above the cylinder 31 and then a pressing barrel 35 covers the spring 34. A key cover 36 is installed above the pressing barrel 35. The outer diameter of the key cover 36 tightly meets the inner diameter of the cylinder 31.

According to the aforementioned structure, when a light source emits toward the lens 121 in the front pen tube 1, the lens causes a circular focusing ring to be located on the upper end of the transparent pen tube. The light is then refracted through the lens 121 and travels to the wall of the transparent pen tube. Then by transmission through the transparent pen tube, the aforementioned light travels to the front-most end of the pen tube 1 without impinging into the pen wick. Moreover, the spring 34 covering the post 33 within the key cover structure 3 will generate a resilient force as the key cover 36 is pressed, so that the key cover 36 will remain in a predetermined position. Therefore, the key cover 36 will not slide upwards or downwards, or vibrate.

The primary structure of the optic lens has a circular, toroidal optic lens 12 which is shaped like an inner tire, as shown in FIG. 2, with inner radius that reduces to zero. When a light source is exactly located above lens 12 so as to align with the central axis of the lens, the light passing through the lens will focus as a radiating optic ring. The ring will further be guided by the transparent pen tube 1 to the front end of the pen tube and therefore create an illumination source.

The cross section cut along a radial direction of the top of the lens includes two convex portions. Changing the arc of the convex portions will change the refraction angle of the light impinging into the lens, and thus the size of the optic ring.

Therefore, by the aforementioned description, it is appreciated that the present invention offers an optic pen useable in a darker environment without the error due to a bad light source. Accordingly, the user may use this pen without being confined by location, time, and environment light source.

Although the present invention has been described with reference to the preferred embodiments, it will be understood that the invention is not limited to the details described above. Various substitutions and modifications have been suggested in the foregoing description, and others will occur to those of ordinary skill in the art. Therefore, all such substitutions and modifications are intended to be embraced with the scope of the invention as defined in the appended claims.

What is claimed is:

1. An optic pen, comprising:

a pen tube, and a key cover structure with an illumination portion, the illumination portion being installed in a distal end of the pen tube, and a front end of the illumination portion being installed with a battery, a light emitting diode, and a light source, a front end of the pen tube being made of transparent material and a rear end of the pen tube being installed with a toroidal, circular optic lens, the key cover structure including a stepped post extending from an upper end of a contact rod within a cylinder, wherein a spring is located above the cylinder and covered with a pressing barrel, and the outer diameter of the key cover tightly meets the inner diameter of the cylinder.

2. The optic pen recited in claim 1 wherein the light source is selected from the group consisting of a bulb and a laser module.

3. An optic pen, comprising:

an end cap with a light source arranged at a front end thereof;

a pen tube, secured to the front end of the end cap, for holding a wick; and a lens arranged in a rear end of the pen tube for focusing a toroidal-shaped ring of light around the wick.

4. The optic pen recited in claim 3 wherein said toroid has a flat side.

5. The optic pen recited in claim 4 wherein said toroid has a cross-section formed by two semicircles.

6. The optic pen recited in claim 5 wherein a curved portion of said semicircles faces the light source.

* * * * *